United States Patent [19]

Nakanishi et al.

[11] Patent Number: 4,746,646

[45] Date of Patent: May 24, 1988

[54] PRINTING PAPER FOR THERMAL TRANSFER PRINTING

[75] Inventors: Toshiaki Nakanishi, Chiba; Daiju Kohga, Tokyo; Yoshihiko Kawano, Tokyo; Toshiki Okazaki, Tokyo, all of Japan

[73] Assignees: Sony Corporation; Honshu Seishi Kabushiki Kaisha, both of Tokyo, Japan

[21] Appl. No.: 855,635

[22] Filed: Apr. 25, 1986

[30] Foreign Application Priority Data

Apr. 26, 1985 [JP] Japan ..... 60-90275
Apr. 26, 1985 [JP] Japan ..... 60-90274

[51] Int. Cl.[4] ..... B41M 5/26

[52] U.S. Cl. ..... 503/227; 8/471; 346/135.1; 428/211; 428/317.9; 428/320.2; 428/321.3; 428/323; 428/331; 428/342; 428/413; 428/478.8; 428/479.6; 428/481; 428/514; 428/535; 428/913; 428/914

[58] Field of Search ..... 8/470, 471; 346/227, 346/135.1; 428/195, 323, 913, 914, 211, 304.4, 317.9, 320.2, 321.1, 321.3, 340–342, 413, 478.8, 479.6, 480, 481, 514, 522, 535, 537.5, 331; 430/945; 503/227

[56] References Cited

U.S. PATENT DOCUMENTS 4,474,859 10/1984 Oshima et al. ..... 428/913
4,490,434 12/1985 Oshima et al. ..... 8/471
4,615,938 10/1986 Hotta et al. ..... 8/471

*Primary Examiner*—Bruce H. Hess
*Attorney, Agent, or Firm*—Hill, Van Santen, Steadman & Simpson

[57] ABSTRACT

A printing paper for thermal transfer printing comprising a substrate, and a dye acceptor layer formed on one surface of the substrate to accept a sublimable dye transferred from a dye carrier ribbon in contact with the dye acceptor layer upon selective heating of the dye carrier ribbon. The dye acceptor layer has a cumulative pore volume of 0.2 to 0.6 $cm^3/g$ and contains a pigment in the form of particles whose median particle diameter of from 0.2 to 2 $\mu m$. In particular, the dye acceptor layer is made of a coating of a resinous binder uniformly dispersing a pigment therein, the coating being impregnated with a resin having good affinity for the sublimable dye.

7 Claims, 1 Drawing Sheet

FIGURE
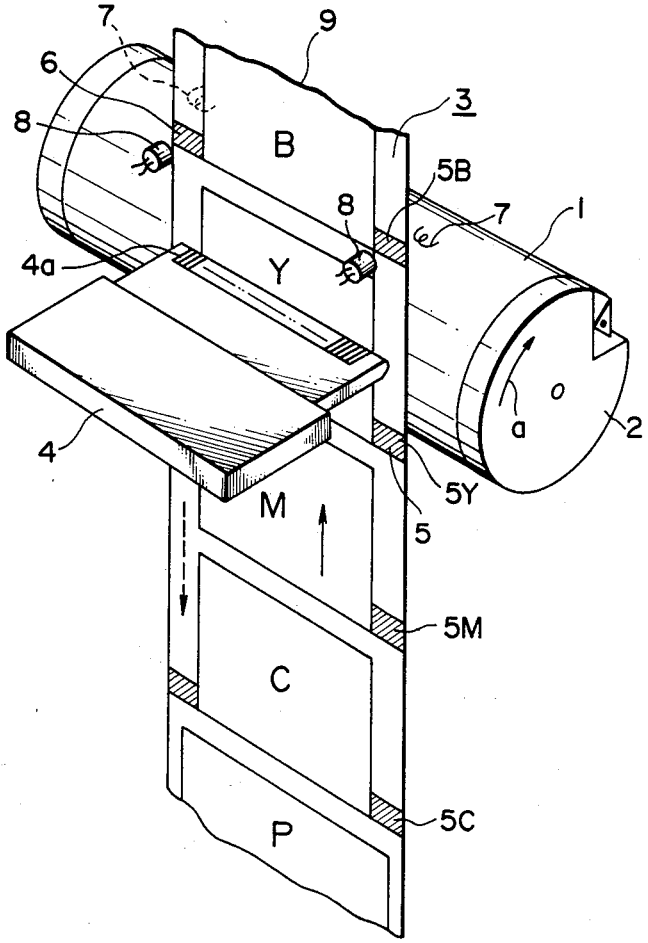

PRINTING PAPER FOR THERMAL TRANSFER PRINTING

BACKGROUND OF THE INVENTION

1. Field of the Invention

This invention relates to a printing paper for making a hard copy of an image picked up by a video camera or a television picture image by thermal transfer of sublimable dyes.

As is known in the art, hard copies by thermal transfer printing are obtained by superposing a dye carrier ribbon having a colorant layer, in which sublimable dyes are contained, on a printing paper and heating the ribbon according to a pattern corresponding to image information, for example, image information picked up by a video camera or television picture image information, causing the sublimable dyes to be transferred on the printing paper. In FIG. 1, there is shown a printer used to obtain a hard copy by thermal transfer printing. The printer has a platen 2 on which a printing paper is wound and which is rotated in the direction arrow (a), and a heating head 4 for pressing a dye carrier ribbon 3 against the platen 2. At the tip of the heating head 4 are arranged heating elements 4*a* corresponding to the number of picture elements which in turn correspond to one scanning line of, for example, a television picture image.

The dye carrier ribbon 3 sandwiched between the heating head 4 and the printing paper under pressure has a sheet substrate 9 on which there are formed colorant layers of a form corresponding to the frame of a television picture image, which contain the respective sublimable dyes of yellow, magenta, cyan and black in color. In other words, the respective colorant layers including yellow Y, magenta M, cyan C and black B are successively formed in a repeated fashion. In order to permit the respective colors to be detected, detection marks 5Y, 5M, 5C and 5B from which the position of each colorant layer is detected are provided at one side edge of the substrate 9 as shown. Likewise, for detection of a block consisting of the dye portions Y, M, C and B, a block position-detecting mark 6 is provided at the other side edge of the substrate 9.

In case where the ink portion Y is, for example, in pressure contact with the printing paper 1 and the respective head elements 4*a* of the head 4 are heated in a pattern corresponding to picture elements of one scanning line according to information corresponding to yellow, e.g. a color signal corresponding to yellow of a television picture signal, the sublimable yellow dye in the dye portion Y is thermally transferred to the printing paper according to the heating pattern.

When the platen 2 is intermittently rotated along the arrow (a) every line corresponding to the respective scanning line, information of each line is thermally transferred until the transfer of yellow color corresponding to one frame is carried out during one cycle of rotation of the platen 2. Subsequently, a similar transfer process is conducted with respect to magenta M, followed by repeating the thermal transfer with respect to cyan C and black B. The transferred images of the sublimable dyes of yellow Y, magenta M, cyan C and black B are superposed and thus a color image is developed on the printing paper to obtain a hard copy.

Reference numerals 7 and 8 are, respectively, a light source (e.g. an infrared light emission diode) and a photo detector which constitute a detector means for detecting the marks 5 (5Y, 5M, 5C and 5B) and 6 in order that signals corresponding to the respective color signals in the dye portions Y, M, C and B are supplied to the head elements 4*a* of the head 4.

A known printing paper used for the above printing operations is, for example, a wood free paper whose surface is coated with a resin coating containing pigments. This type of printing paper is described, for example, in Japanese Laid-open Patent Application Nos. 57-91296, 57-107885 and 58-209596.

The printing paper has an improved color density or dying property and an improved fade resistance, but there is an increasing demand of further improvements of these properties. In addition, the known printing paper is not always satisfactory in preventing sticking between the printing paper and the dye carrier ribbon. More particularly, if sticking takes place, all the ink on the dye carrier ribbon is transferred and deposited on the surface of the printing paper, disenabling one to obtain a print with a clear image.

OBJECTS AND SUMMARY OF THE INVENTION

It is an object of the present invention to provide an improved printing paper for thermal transfer printing.

It is another object of the invention to provide a printing paper for thermal transfer printing which has a good dyeing property without causing sticking between the paper and a dye carrier ribbon.

It is a further object of the invention to provide a printing paper for thermal transfer printing which is particularly suitable for making a hard copy of picture image.

It is a still further object of the invention to provide a printing paper for thermal transfer paper in which a dye on a dye carrier ribbon can be transferred to the printing paper in proportion to heat energy from a thermal printing head.

According to one aspect of the present invention, there is provided a printing paper for thermal transfer printing which comprises a substrate, and a dye acceptor layer formed on one surface of the substrate to receive a sublimable dye transferred from a dye carrier ribbon in contact with the dye acceptor layer upon selective heating of the dye carrier ribbon, the dye acceptor layer being impregnated with a resin having good affinity for the dye and having a cumulative pore volume ranging between 0.2 and 0.6 $cm^3/g$ and a median pore diameter ranging between 0.2 and 2.0 $\mu m$.

According to another aspect of the invention, there is also provided a printing paper for thermal transfer printing which comprises a substrate, and a dye acceptor layer formed on a surface of the substrate to receive a sublimable dye transferred from a dye carrier ribbon in contact with the dye acceptor layer upon selective heating of the dye carrier ribbon, the dye acceptor layer consisting essentially of a coating of a resinous binder and a pigment uniformly dispersed therein and a dye acceptor resin impregnated in the coating and having affinity for the sublimable dye, the pigment having an average oil absorption ranging between 35 and 140 milliliters per 100 g of the pigment and having a volume median particle diameter of between 2 and 20 $\mu m$.

BRIEF DESCRIPTION OF THE DRAWINGS

The sole figure is a schematic view of a printer illustrating the printing mechanism for printing on a printing paper to obtain a hard copy.

DETAILED DESCRIPTION AND EMBODIMENTS OF THE INVENTION

As described above, a printing paper for thermal transfer printing according to one embodiment of the invention comprises a support such as a wood free paper and a dye acceptor layer formed on one surface of the support. The dye acceptor layer can receive a dye sublimated from a colorant layer of a dye carrier ribbon by application of heat to the colorant layer comprising the dye. In the practice of the invention, when formed on a film, the dye acceptor layer is made of a binder and a pigment dispersed in the binder and should have a cumulative pore volume between 0.2 and 0.6 $cm^3/g$ and a median pore diameter between 0.2 and 2 $\mu m$. Preferably, the dye acceptor layer is impregnated with a resin having good affinity for sublimable dyes used in the dye carrier ribbon, e.g. a polyester resin. For the impregnation of the resin, a solution of the resin in a suitable solvent is used as will be particularly described hereinafter.

The cumulative pore volume and the median pore diameter are determined by measurement of a pore radius and a pore volume by the use of a mercury pressure porosimeter. The measuring techniques are particularly described, for example, in Industrial Engineering Chemistry (Anal, Ed.), Vol. 17, p. 782 (1845) and Vol. 62, p. 25, (1970). The results of the measurement are used to calculate a curve of a pore volume distribution (see "Hyomen" Vol. 13, No. 10, p. 558 (1975) and JAPAN TAPPI, Vol. 33, No. 5, p. 347 (1979)), from which the cumulative pore volume is calculated. The term "cumulative pore volume" used herein is intended to mean a value determined up to a mercury pressure of 1500 $kg/cm^2$ and the term "median pore diameter" is a pore diameter at the time when the cumulative pore volume is 50%.

The cumulative pore volume and the median pore diameter can be selectively controlled depending on the particle size of a pigment in the dye acceptor layer, the ratio by weight of the pigment P and the binder B, P/B, and the coating conditions of the dye acceptor layer including calendering conditions.

In accordance with another embodiment of the invention, the printing paper comprises a support such as a wood free paper, and a dye acceptor or recording layer which is a coating containing a pigment having an average oil absorption between 35 and 140 ml/100 g and a volume median particle diameter between 2 and 20 $\mu m$ and impregnated with a resin having good affinity for sublimable dyes, e.g. a polyester resin.

The average oil absorption of pigment is determined according to the method prescribed in JIS K5101. If a plurality of pigments are used in combination, the average oil absorption will be determined according to the following equation (1)

$$\text{Average oil absorption (ml/100 g)} = (Axa + Bxb + Cxc \ldots)/100$$

in which A, B, C . . . and a, b, c . . . are, respectively, oil absorptions (ml/100 g) of the respective pigments used in combination and mixing ratios (%) of the respective pigments in the pigment composition.

The volume median particle diameter is detemined as follows: a measuring instrument Counter Model TAII, made by Coulter Electronics Inc., was used to determine a distribution of volume percent in particle size class (%) and a cumulative volume percent of a pigment in a coating paint and the volume median particle diameter was determined as a particle diameter at the time when the cumulative volume percent is 50%.

The present invention is more particularly described by way of examples in which procedures of making the printing paper are also described.

EXAMPLE 1

First, pigments and binders are mixed. The mixture may be subjected either to dispersion by a homo mixer (hereinafter referred to simply as HM dispersion) or to milling by a sand grinder (hereinafter referred to simply as SG dispersion) to obtain a slurry.

In the HM dispersion, 100 parts by weight of a pigment is mixed with 5 parts by weight of polyvinyl alcohol binder in water to obtain an aqueous slurry having a solid content of 30 wt %. Therafter, the slurry is dispersed in a homo mixer. If sodium silicoaluminate or amorphous silica is used for the HM dispersion, the solid contents are controlled to be 25 wt % for the aluminate and 15 wt % for the silica.

In the SG dispersion, 5 parts by weight of polyvinyl alcohol is mixed with 100 parts by weight of a pigment in such a way that the resulting aqueous slurry has a solid content of 40 wt %. The slurry is subjected to milling by a sand grinder to reduce the particle size as desired, thereby obtaining a slurry.

Subsequently, polyvinyl alcohol serving as a binder is further added to the dispersion slurry obtained by the HM dispersion or SG dispersion so that the ratio by weight of the binder to the pigment is 8:2, followed by further adding water to make a solid content of 25 wt %. The resulting coating paint is applied onto a wood free paper support having a weight basis of 160 $g/m^2$ in an amount of 10 $g/m^2$, calculated as solids, thereby forming a coating layer on the support.

Next, a solution of a polyester resin serving as a dye acceptor in a solvent such as methyl ethyl ketone (MEK) or toluene having a solid content of 10 wt % is impregnated in the coating layer in an amount of 2 $g/m^2$ on the dry basis and dried. Thereafter, the thus dried support is subjected to calendering at a line pressure of 100 kg/cm and then to heat treatment at 80° C. for 24 hours, thereby causing the crosslinking reaction. In this manner, a printing paper in which the recording layer is formed on the support can be obtained.

The above procedure is repeated using different types of pigments and different dispersion methods to obtain printing paper sample Nos. 1 to 7. In Table 1, there are shown pigment compositions, the dispersion methods used to make slurries and a volume median particle diameter, Sg, in case where a plurality of pigments are used. The results of measurement are also shown in the table with respect to cumulative pore volume Vs ($cm^3/g$) and median pore diameter $g_\phi(\mu m)$ of the dye acceptor layer, surface strength Ps as a coating film, whitening state $W_H$ and sticking state St of a print in high density printing, and saturation color densities of magenta M, cyan C and yellow Y. In the samples 3, 4, 6 and 7, pigments are used singly. The other samples, respectively, use two or more pigments.

The transfer or print on the respective printing papers is carried out using a dye carrier ribbon. More particularly, the ribbon is brought into contact with the recording layer of each printing paper and heat is applied under pressure from the back side of the ribbon by means of a thermal head at 200° C. for 3 seconds, thereby transferring the dye on the recording layer of the printing paper on which the dye is colored. The dye carrier ribbon is made as follows. An ink composition of the following formulation is kneaded to obtain a dye composition of magenta M.

Kayaset Red, commercial name of Nippon Kayaku Co., Ltd. . . . 6 parts by weight
Hydroxylpropyl cellulose . . . 6 parts by weight
Ethyl cellulose . . . 5 parts by weight
Carbon black (average particle size 100 m) . . . 5 parts by weight
Isopropyl alcohol . . . 78 parts by weight A yellow ink paint is prepared using the above formulation using Kayaset Yellow (commercial name of Nippon Kayaku Co., Ltd.) as a disperse dye instead of the Red. Likewise, a cyan ink paint is prepared using Kayaset Blue FR (commercial name of Nippon Kayaku Co., Ltd.) as a disperse dye in the above formulation, and a black ink paint is prepared using Kayaset Black 922 (commercial name of Nippon Kayaku Co., Ltd.) as a disperse dye in the above formulation. The respective ink paints are applied onto a 20 μm thick condenser paper by the use of a three-stage gravure coater.

Comparative samples 1 to 6 are also made using pigments and dispersion methods indicated in Table 2 along with the results of the measurements similar to Table 1.

TABLE 1

| Sample No. | Pigment Composition in Coating Paint and Dispersion Method | Characteristics of Dye Receiver Layer: Vs ($cm^3/g$) | φd (μm) | Ps | $W_H$ | St | Saturation Color Density: M | C | Y |
|---|---|---|---|---|---|---|---|---|---|
| 1 | Ground calcium carbonate $CaCO_3$/amorphous silica $SiO_2$ = 7/3 (by weight) (HM dispersion, Sg = 5 μm) (HM dispersion, Sg = 4 μm) | 0.25 | 1.5 | O | O | O | 1.38 | 1.25 | 0.91 |
| 2 | Aluminium hydroxide $Al(OH)_3$/urea-formalin condensation = 7/3 (by weight) (HM dispersion, Sg = 6 μm) (HM dispersion, Sg = 6 μm) | 0.29 | 1.3 | O | O | O | 1.32 | 1.18 | 0.84 |
| 3 | Synthetic aluminium silicate $Al_2O_3.9SiO_2.nH_2O$ (SG dispersion, Sg = 10 μm) | 0.40 | 2.0 | O | O | O | 1.33 | 1.22 | 0.87 |
| 4 | Synthetic magnesium silicate $2MgO.6SiO_2.nH_2O$ (SG dispersion, Sg = 2 μm) | 0.50 | 0.5 | O | O | O | 1.30 | 1.24 | 0.84 |
| 5 | Synthetic aluminium silicate/$MgCO_3$/sodium alumino-silicate $Na_2O.Al_2O_3.2SiO_2$ = 55/5/40 (by weight) (SG dispersion, Sg = 10 μm) (HM dispersion, Sg = 10 μm) | 0.57 | 0.2 | O | O | O | 1.40 | 1.30 | 0.92 |
| 6 | Precipitated calcium carbonate $CaCO_3$ (HM dispersion, Sg = 1 μm) | 0.2 | 0.5 | O | O | O | 1.31 | 1.20 | 0.88 |
| 7 | Amorphous silica $SiO_2$ (HM dispersion, Sg = 1 μm) | 0.6 | 0.3 | O | O | O | 1.40 | 1.28 | 0.91 |

TABLE 2

| Comparative Sample No. | Pigment Composition in Coating Paint and Dispersion Method | Characteristics of Dye Receiver Layer: Vs ($cm^3/g$) | φb (μm) | Ps | $W_H$ | St | Saturation Color Density: M | C | Y |
|---|---|---|---|---|---|---|---|---|---|
| 1 | Ground calcium carbonate (HM dispersion, Sg = 10 μm) | 0.09 | 4 | O | O | X | 1.05 | 1.0 | 0.78 |
| 2 | Aluminium hydroxide (HM dispersion, Sg = 6 μm) | 0.11 | 3 | O | O | X | 1.18 | 1.08 | 0.79 |
| 3 | Kaolin clay (HM dispersion, Sg = 1 μm) | 0.20 | 0.1 | O | O | X | 1.0 | 0.9 | 0.70 |
| 4 | Synthetic magnesium silicate/amorphous silica = 1/1 (by weight) (SG dispersion, Sg = 3 μm) (HM dispersion, Sg = 3 μm) | 0.65 | 0.15 | Δ | X | O | 1.15 | 1.27 | 0.87 |
| 5 | Sodium alumino-silicate (HM dispersion, Sg = 8 μm) | 0.73 | 0.2 | X | X | O | 1.24 | 1.27 | 0.88 |
| 6 | Amorphous silica $SiO_2$ (HM dispersion, Sg = 10 μm) | 0.4 | 4 | O | O | O | 1.2 | 1.11 | 0.82 |

In Tables 1 and 2, the surface strength Ps of the recording layer is determined as follows. An adhesive tape is adhered to each coating or recording layer after the thermal treatment of the respective printing papers and is peeled off slowly along the direction of 180° with respect to the recording layer. If the coating layer is not picked off on the adhesive layer of the tape at all, the surface strength is evaluated as "θ". Similarly, if the coating layer is picked off in small amounts, the surface strength is evaluated as "Δ". When the coating layer adhered with the tape is uniformly picked off, the surface strength is evaluated as "x".

The whitening $W_H$ in the print portion of a high density is intended to mean the phenomenon that when the printing is effected at high energy, the dye sublimated and adsorbed on the pigment surface is diffused into the inside of the pigment due to the high energy, so that the concentration of the dye lowers and is hidden with the pigment, causing the print to be whitened. When whitening does not occur, it is evaluated as "Φ" and the occurrence of whitening is indicated by "x".

The sticking state St is intended to check whether or not a dye on the dye carrier ribbon and a printing test paper are sticked with each other by thermal transfer printing. If sticking does not take place, the state is evaluated as "Φ". When sticking is observed, it is evaluated as "x".

The saturation color density is determined by subjecting the respective dyes of the dye carrier ribbon to transfer printing on a printing test paper and measuring saturation color densities of the respective dyes by the sue of Macbeth RD-514 using the Wratten gelatin filters including a #47 blue filter, a #25 red filter and a #58 green filter.

As will be apparent from Table 1, the samples 1 to 7 of the present invention show satisfactory results with respect to the surface strength, whitening and sticking while keeping high saturation color densities. The test results for the comparative samples shown in Table 2 reveal that when the cumulative pore volume, Vs, is set at a smaller level than in the present invention, sticking takes place as in comparative samples 1 and 2, with the color density being low. On the other hand, when the cumulative pore volume is large as in comparative samples 4 and 5, whitening takes place with dullness of the color. In addition, color reproducibility is poor. Moreover, when the cumulative pore volume Vs is in the range of 0.2 to 0.6 $cm^2/g$ and the median pore diameter, $\phi g$, is small, sticking occurs as will be seen in comparative sample 3. As with comparative samples 1, 2 and 6, when the mediam pore diameter is larger, the surface property deteriorates with a lowering of color density.

As will be apparent from the above results, the printing papers of the invention have a high saturation color density or a high dyeing property, ensuring a high color density without involving any sticking problem. The recording layer has a high surface strength and does not have the whitening problem in high density print. If the cumulative pore volume, Vs, is smaller than 0.2 $cm^2/g$, the capability of receiving a dye lowers and the surface of the recording layer is covered with the ink composition to make a smooth surface, thus tending sticking to occur. In addition, diffusion of the dye become insufficient, so that the saturation color density is considered to become low. On the contrary, when the cumulative pore volume, Vs, exceeds 0.6 $cm^2/g$, the film strength lowers and the dye diffuses into the coating layer, causing occurrence of whitening, dullness of color and deterioration of color reproducibility. If the median pore diameter, $\phi g$, is smaller than 0.2 $\mu m$, the recording surface is made smooth by covering with a dye and thus, sticking tends to occur. On the contrary, when the median pore diameter, $\phi g$, exceeds 2 $\mu m$, the surface property deteriorates and dye diffusion undesirably takes place to a great extent with a small surface area of the dye acceptor. Thus, the saturation color density is considered to lower.

The pigments used in the printing paper according to the invention are not limited to those used in the above example, but ordinary pigments which are white or transparent and resistant to heat may also be used. Examples of the pigments used in the present invention include talc, precipitated calcium carbonate, kaolin.-clay, barium sulfate, satin white, alumina and the like.

The binders may include, aside from PVA, protein binders such as casein, starch, synthetic latices, cellulose derivatives and the like.

The ratio by weight of the amount of pigment, P, and the amount of binder, B, in a coating paint for forming a coating layer serving as a recording layer should be selected according to a cumulative pore volume and a median pore size which are finally determined.

The amount of the coating layer is preferably in the range of from 2 to 20 $g/m^2$. This is because with amounts less than 2 $g/m^2$, the coating on a substrate does not become uniform and thus the coating layer lacks the capability of absorbing a dye acceptor resin therein, causing the sticking problem to occur. Over 20 $g/m^2$, a dye diffuses into the coating layer with a lowering of color density.

The impregnation amount of the dye acceptor resin in the recording layer is preferably from 0.5 to 5 $g/m^2$ and most preferably from 1 to 3 $g/m^2$. Amounts less than 0.5 $g/m^2$ are unfavorable because the amount of the acceptor resin in the surface of the coating layer becomes so small that a satisfactory color density cannot be obtained. When the amount exceeds 5 $g/m^2$, the acceptor resin film is liable to be formed on the recording layer, thus tending to cause sticking. The dye acceptor resin may include, aside from the polyester resin, epoxy resins, acetate resins, polyamide (nylon) resins and the like.

EXAMPLE 2

The general procedure of Example 1 was repeated except that pigments used have volume median particle diameters and average oil absorption in ranges, respectively defined with respect to the second embodiment of the invention, thereby obtaining printing paper samples 11 to 25. These sample are subjected to thermal transfer printing using a dye carrier ribbon of the same as used in Example 1.

The pigment composition and the dispersion method for preparing the composition are shown in Table 3, in which when a plurality of pigments are used, volume median particle diameters of the respective pigments are shown. In the table, a volume median particle diameter, Sg ($\mu m$), and an average oil absorption of the pigments as a whole are also shown along with a surface layer strength, Ps, a whitening state, $W_H$, of a print in high density printing, a sticking state, St, and saturation color densities of magenta M, cyan C and yellow Y are also shown. Samples 11 to 19 and 24 employ pigments singly and samples 20 to 23 used combinations of two or more pigments. Table 4 shows the materials used in comparative samples 11 to 21 and test results of the samples.

In Table 4, the mark "—" indicates that the recording layer is fully separated and thus the measurement is impossible.

TABLE 3

| Sample No. | Pigment Composition in Coating Paint and Dispersion Method | | Pigment Composition Sg (μm) | Pigment Composition Ab (ml/100 g) | Characteristics of Recording Layer Ps | Characteristics of Recording Layer $W_H$ | Characteristics of Recording Layer Sl | Saturation Color Density M | Saturation Color Density C/ | Saturation Color Density Y |
|---|---|---|---|---|---|---|---|---|---|---|
| 11 | Talc ($3MgO.4SiO_2.H_2O$) | HM dispersion | 3 | 40 | O | O | O | 1.28 | 1.25 | 0.84 |
| 12 | Talc ($3MgO.4SiO_2.H_2O$) | HM dispersion | 10 | 40 | O | O | O | 1.25 | 1.20 | 0.84 |
| 13 | Talc ($3MgO.4SiO_2.H_2O$) | HM dispersion | 15 | 40 | O | O | O | 1.25 | 1.18 | 0.85 |
| 14 | Synthetic Al silicate ($Al_2O_3.9SiO_2.nH_2O$) | SG dispersion | 2 | 80 | O | O | O | 1.36 | 1.34 | 0.89 |
| 15 | Synthetic Al silicate ($Al_2O_3.9SiO_2.nH_2O$) | SG dispersion | 6 | 80 | O | O | O | 1.33 | 1.25 | 0.87 |
| 16 | Synthetic Al silicate ($Al_2O_3.9SiO_2.nH_2O$) | SG dispersion | 20 | 80 | O | O | O | 1.25 | 1.15 | 0.85 |
| 17 | Synthetic Mg silicate ($2MgO.6SiO_2.nH_2O$) | SG dispersion | 4 | 110 | O | O | O | 1.40 | 1.38 | 0.91 |
| 18 | Synthetic Mg silicate ($2MgO.6SiO_2.nH_2O$) | SG dispersion | 10 | 110 | O | O | O | 1.33 | 1.25 | 0.86 |
| 19 | Synthetic Mg silicate ($2MgO.6SiO_2.nH_2O$) | SG dispersion | 18 | 110 | O | O | O | 1.28 | 1.12 | 0.86 |
| 20 | Ground $CaCO_3$/precipitated $CaCO_3$ 1/1 (by weight) (Sg = 5 μm, Ab = 30 ml/100 g)/(Sg = 2 μm, Ab = 40 ml/100 g) | HM dispersion for mixing | 4 | 35 | O | O | O | 1.28 | 1.27 | 0.86 |
| 21 | Synthetic Mg silicate/Al hydroxide (SG dispersion, Sg = 4 μm, Ab = 110 ml/100 g)/(HM dispersion, Sg = 1 μm, Ab = 20 ml/100 g) | | 3 | 70 | O | O | O | 1.35 | 1.20 | 0.87 |
| 22 | Synthetic Al silicate/$MgCO_3$/Na silico-aluminate = 80/2/18 (by weight) (SG dispersion, Sg = 6 μm, Ab = 80 ml/100 g)/(SG dispersion, Sg = 6 μm, Ab = 90 ml/100 g)/(SG dispersion, Sg = 3 μm, Ab = 170 ml/100 g) | | 6 | 96 | O | O | O | 1.42 | 1.40 | 0.95 |
| 23 | Synthetic Al silicate/Na silico-aluminate = 1/1 (by weight) (SG dispersion, Sg = 5 μm, Ab = 100 ml/100 g)/(SG dispersion, Sg = 3 μm, Ab = 170 ml/100 g) | (by weight) | 4 | 135 | O | O | O | 1.40 | 1.38 | 0.90 |
| 24 | Amorphous silica ($SiO_2$) | HM dispersion | 4 | 140 | O | O | O | 1.35 | 1.25 | 0.88 |

TABLE 4

| Comparative Sample No. | Pigment Composition in Coating Paint and Dispersion Method | | Pigment Composition Sg (μm) | Pigment Composition Ab (ml/100 g) | Characteristics of Recording Layer Ps | Characteristics of Recording Layer $W_H$ | Characteristics of Recording Layer $S_1$ | Saturation Color Density M | Saturation Color Density C | Saturation Color Density Y |
|---|---|---|---|---|---|---|---|---|---|---|
| 11 | Talc | HM dispersion | 1 | 40 | Δ | O | Δ | 1.28 | 1.25 | 0.84 |
| 12 | Talc | HM dispersion | 30 | 40 | O | O | O | 1.10 | 1.05 | 0.75 |
| 13 | Synthetic Al silicate | SG dispersion | 1 | 80 | Δ | O | Δ | 1.36 | 1.34 | 0.89 |
| 14 | Synthetic Al silicate | SG dispersion | 25 | 80 | O | O | O | 1.20 | 1.08 | 0.75 |
| 15 | Synthetic Mg silicate | SG dispersion | 1 | 110 | Δ | O | Δ | 1.40 | 1.38 | 0.91 |
| 16 | Synthetic Mg silicate | SG dispersion | 30 | 110 | O | O | O | 1.15 | 1.05 | 0.74 |
| 17 | Kaolin.clay | HM dispersion | 1 | 20 | O | O | X | 1.0 | 0.9 | 0.65 |
| 18 | Ground $CaCO_3$ | MH dispersion | 25 | 25 | O | O | X | 1.05 | 1.0 | 0.75 |
| 19 | Sodium alumino-silicate | HM dispersion | 8 | 170 | X | X | O | 1.24 | 1.27 | 0.88 |
| 20 | Amorphous silica | HM dispersion | 4 | 300 | XX | X | O | — | — | — |
| 21 | Synthetic Al silicate/sodium alumino-silicate = 3/7 (by weight) (SG dispersion, Sg = 5 μm, Ab = 100 ml/100 g)/(SG dispersion, Sg = 3 μm, Ab = 170 ml/100 g) | | 4 | 149 | Δ | X | O | 1.24 | 1.25 | 0.88 |

As will be apparent from Table 3, the samples 11 to 24 of the present invention have high saturation color densities and good results are obtained with respect to the surface strength, whitening and sticking. The results of Table 4 reveal that when the average oil absorption of the pigments used is selected to be in the range of from 35 to 140 ml/100 g but the volume median particle diameter, Sg, is 1 μm which is smaller than 2 m, sticking takes place as in the cases of samples 11, 13 and 15. When the volume median particle diameter exceeds 20 μm, the saturation color density lowers as will be seen in samples 12, 14, 16 and 18. With these samples 12, 14, 16 and 18, it is observed that the surface of the recording layer becomes much roughened. When the volume median particle diameter, Sg, is in the range of from 2 to 20 μm but the average oil absorption, Ab, exceeds 140 ml/100 g, the whitening of the high density print takes place along with a lowering of the surface strength as is observed in samples 19, 20 and 21. When the average oil absorption is less than 35 ml/100 g, sticking takes place, as will be seen in comparative samples 17, 18, with a lowering of the saturation color density.

As will be apparent from the foregoing, when the pigments used have an average absorption oil of from 35 to 140 ml/100 g and a volume median particle size of from 2 to 20 μm according to the invention, a high saturation color density or a high dyeing property is attained with a high color density being obtained. In addition, the printing paper has not any sticking problem and a high surface strength as the recording layer without involving the whitening problem in high density printing. More specifically, when the average oil absorption is less than 35 ml/100 g, the dye acceptor is rarely infiltrated into the coating layer but is apt to form a film on the coating surface, thus causing sticking. In addition, when the dye acceptor resin is impregnated to such an extent that the film is not formed, a sublimable dye is liable to be left on the surface and sticking may take place on solidification. Insufficient diffusion of the dye will result in a lowering of the color density.

When the average oil absorption exceeds 140 ml/100 g, a large amount of a binder is necessary. Otherwise, as in comparative samples 19, 20 and 21, the recording layer will be short of the binder with a low surface strength. In order to impart a satisfactory surface strength, a very large amount of a binder is necessary, which is poor in economy. Moreover, once sublimated dye molecules are rediffused into the pigment, leading to whitening in a high density print due to the hiding property of the pigment. On the other hand, when the median particle diameter is smaller than 2 μm, the surface of the recording layer becomes smooth, which is unlikely to readily release from the dye carrier ribbon, thus causing sticking. In addition, when the particle diameter is too small, a large amount of a binder becomes necessary and thus the surface strength lowers at the same level of P/B in which P represents an amount by weight of a pigment used and B represents an amount by weight of a binder. If the median particle diameter exceeds 20 μm, the resulting surface becomes considerably roughened, so that the uniform contact between the dye carrier ribbon and the printing paper is not obtained, leading to insufficient thermal conduction. This results in unsatisfactory sublimation and adsorption of a dye with a lowering of color density. Too rough a surface deteriorates in reproducibility and has not practical utility as a printing paper.

In this embodiment, the ratio by weight of a binder and a pigment in a coating paint is preferably in the range of 95/5 to 65/35. If the ratio is less than 1.8, the content of a binder is so large that a dye acceptor exudes from the coating layer to form a film on the coating surface, causing sticking. If the ratio exceeds 19:1, a good surface strength cannot be obtained.

As described in detail hereinbefore, the printing paper of the invention has a high color density and can solve the problem of sticking with a dye carrier ribbon, and can yield a hard copy of good image quality. This is very advantageous in practical applications.

The printing paper of the invention may further comprise a transparent cover film formed on the recording layer to physically and chemically protect the recording layer and to prevent browning of the layer. The cover film, is described, for example, in Japanese Patent Application No. 58-192959 and Utility Model No. 59-161609, assigned to the same assignee, which are incorporated herein by reference.

What is claimed is:

1. A printing paper for thermal transfer printing comprising a substrate, and a dye acceptor layer formed on one surface of said substrate to receive a sublimable dye transferred from a dye carrier ribbon in contact with said dye acceptor layer upon selective heating of said dye carrier ribbon, said dye acceptor layer consisting essentially of a coating of a resinous binder uniformly dispersing a pigment therein and forming a plurality of micropores and a resin which has good affinity for the sublimable dye being impregnated in said coating and uniformly covering the surface of said micropores, said dye acceptor layer having a cumulative pore volume of from 0.2 to 0.6 $cm^3/g$ and the pigment having a median pore diameter of from 0.2 to 2.0 micron.

2. A printing paper according to claim 1, wherein said recording layer is coated in an amount of from 2 to 20 $g/m^2$ on the dry basis.

3. A printing paper according to claim 1, wherein said resin is impregnated in an amount of from 0.5 to 5 $g/m^2$.

4. A printing paper according to claim 3, wherein said resin is a polyester resin, an epoxy resin, an acetate resin or a polyamide resins.

5. A printing paper according to claim 1, wherein said resinous binder is polyvinyl alcohol, a protein adhesive, starch, a synthetic latex or a cellulose derivative.

6. A printing paper for thermal transfer printing comprising a substrate, and a dye acceptor layer formed on one surface of said substrate to receive a sublimable dye transferred from a dye carrier ribbon in contact with said dye acceptor layer upon selective heating of said dye carrier ribbon, said dye acceptor layer consisting essentially of a coating of a resinous binder uniformly dispersing a pigment therein and a resin impregnated in said coating and having affinity for the sublimable dye, said pigment having an average oil absorption of from 35 to 140 ml per 100 grams of said pigment and a median particle diameter of from 2 to 20 μm.

7. A printing paper according to claim 6, wherein a ratio by weight of the resinous binder and the pigment in said coating is in the range of 95/5 to 65/35.

* * * * *